United States Patent [19]

Kawamura et al.

[11] Patent Number: 4,825,568

[45] Date of Patent: May 2, 1989

[54] APPARATUS FOR CONTROLLING POSTURE OF WORK IMPLEMENT OF LOADER

[75] Inventors: Shoichiro Kawamura; Tadashi Nakao; Kenkichi Nozaka, all of Osaka, Japan

[73] Assignee: Kubota Ltd., Osaka, Japan

[21] Appl. No.: 230,997

[22] Filed: Aug. 11, 1988

[30] Foreign Application Priority Data

Aug. 12, 1987 [JP] Japan ..... 62-202327
Aug. 12, 1987 [JP] Japan ..... 62-123884[U]

[51] Int. Cl.[4] ..... E02F 3/00; B66C 23/00

[52] U.S. Cl. ..... 37/118 R; 414/686; 414/722; 172/274

[58] Field of Search ..... 37/118 R, 118 A, 4; 414/685, 686, 694, 697, 722, 723, 724, 727; 172/274, 272, 273

[56] References Cited

U.S. PATENT DOCUMENTS

| | | | |
|---|---|---|---|
| 2,456,491 | 12/1948 | Collins | 414/722 |
| 3,145,488 | 8/1964 | French | 414/722 |
| 3,161,306 | 12/1964 | Granryd | 414/722 |
| 3,436,099 | 4/1969 | Long | 37/118 R |
| 3,487,958 | 1/1970 | Shook et al. | 414/685 |
| 4,370,090 | 1/1983 | Shumaker et al. | 414/685 |
| 4,389,151 | 6/1983 | Ferguson | 414/685 |
| 4,395,193 | 7/1983 | Christensen et al. | 37/118 R |
| 4,431,364 | 2/1984 | Redenbarger et al. | 414/697 |
| 4,737,067 | 4/1988 | Samejima et al. | 414/686 |
| 4,755,101 | 7/1988 | Hamada et al. | 414/686 |

FOREIGN PATENT DOCUMENTS

| | | | |
|---|---|---|---|
| 255774 | 5/1963 | Australia | 37/118 R |
| 550637 | 9/1956 | Belgium | 37/118 R |
| 721919 | 11/1965 | Canada | 37/118 R |
| 1563358 | 4/1969 | France | 414/685 |

*Primary Examiner*—Eugene H. Eickholt
*Attorney, Agent, or Firm*—Birch, Stewart, Kolasch, & Birch

[57] ABSTRACT

An apparatus for controlling the posture of the work implement of a loader comprises a boom supported by a boom pivot on a mast secured to a vehicle body and movable upward and downward by a boom cylinder, first and second arms supported by an intermediate portion of the boom and pivotally movable relative to each other, a pivotal member pivoted to the boom by the boom pivot, a first connecting member operatively connecting a point on the pivotal member away from the pivoted point thereof to the first arm, a second connecting member connecting the second arm to the work implement at the forward boom end, an engaging portion for engaging the second arm with the first arm when the implement is moved by an implement cylinder in the scooping direction approximately into a specified posture, and an interlocking member operatively connecting the pivotal member to an implement control valve for the implement cylinder so that the valve is operated in the dumping direction by the movement of the pivotal member with the rise of the boom after the second arm is engaged with the first arm by the engaging portion. The implement can be maintained in the specified posture when the boom is raised, preventing earth from spilling from the implement.

18 Claims, 4 Drawing Sheets

APPARATUS FOR CONTROLLING POSTURE OF WORK IMPLEMENT OF LOADER

FIELD OF THE INVENTION AND PRIOR ART STATEMENT

The present invention relates to an apparatus for controlling the posture of work implements of loaders such as front loaders.

Front loaders are used as attached to tractors with their booms equipped with a bucket serving as a work implement. When sand or earth is scooped up with the bucket, the booms are raised with the opening of the bucket held in a horizontal posture. As the booms are raised at an increasing angle, the opening of the bucket tilts rearwardly downward even if horizontal at a low level, permitting the scooped earth to spill toward the tractor.

To prevent the spillage of earth, there is a need to alter the posture of the bucket toward the dumping direction with the rise of the booms so as to maintain the bucket opening in a horizontal position at all times. However, it is not easy for the operator to maintain the bucket in the horizontal position manually.

Accordingly, conventional front loaders have a sensor for detecting the posture of the bucket and a sensor for detecting the angle of rise of the booms and are thereby adapted to electrically detect the posture of the bucket with the rise of the booms and control the bucket cylinder control valve through an electromagnetic valve so that the bucket is corrected to a horizontal posture not permitting spillage of earth by the dumping operation of the bucket cylinders.

Nevertheless, the prior art described requires the two sensors, electromagnetic valve or like expensive electric components and involves difficulties in assuring improved reliability.

OBJECTS AND SUMMARY OF THE INVENTION

The main object of the present invention is to overcome the foregoing problem heretofore encountered.

An important object of the present invention is to convert the rising movement of the booms from a position at which the work implement is brought into a specified posture to an action to operate an implement control valve in the dumping direction, through a link mechanism provided between the implement and the control valve so as to maintain the implement in the specified posture when the booms are raised.

Another important object of the invention is to provide the link mechanism for entirely mechanically controlling the implement control valve, the link mechanism comprising a pivotal member connected to the implement control valve by interlocking means, a first arm connected by a first connecting member to the pivotal member at a point away from the point where the pivotal member is supported, a second arm connected to the work implement by a second connecting member, and means for engaging the first arm with the second arm to make the first and second arms, and the first and second connecting members immovable relative to the boom when the implement is brought into the specified posture.

Another object of the invention is to render the work implement movable through an increased angle by a flexible link connected between the rear upper portion of the implement and each beam and connected to each implement cylinder.

Another object of the invention is to provide on one of the first and second arms an engaging portion engageable with the other arm for detecting that the opening has become horizontal or slightly tilted rearward from the horizontal position.

Another object of the invention is to make the pivotal member movable to cause the implement control valve to perform a dumping action with the rise of the boom by supporting the pivotal member by the pivot of the boom and connecting a portion of the pivotal member away from the pivoted portion thereof to the first arm by the first connecting member.

Another object of the invention is to provide an arrangement comprising a first pivotal element for operating a boom control valve, a second pivotal element supported on the first pivotal element for operating the implement control valve, and a control lever attached to the second pivotal element to make the two control valves operable with the single control lever, the second pivotal element being connected to the pivotal member by the interlocking means, whereby the implement control valve is caused to effect a dumping action with the rise of the boom.

Another object of the invention is to make the connecting member or the interlocking means of the link mechanism adjustable in length so as to render the specified posture of the work implement adjustable in accordance with the slope of the ground.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein:

FIG. 1 is a side elevation showing the overall construction and the movement of the embodiment;

FIGS. 2 and 3 are an enlarged side elevation and a perspective view of an intermediate portion of a boom;

FIG. 4 is an enlarged perspective view of a control unit;

FIG. 5 is a plan view in section of the control unit;

FIG. 6 is a view in section taken along the line E—E in FIG. 5;

FIG. 7 is a view in section taken along the line F—F in FIG. 5;

FIG. 8 is an overall side elevation of the same;

FIG. 9 is an enlarged perspective view of a control unit; and

DESCRIPTION OF THE PREFERRED EMBODIMENTS

Figure 1:
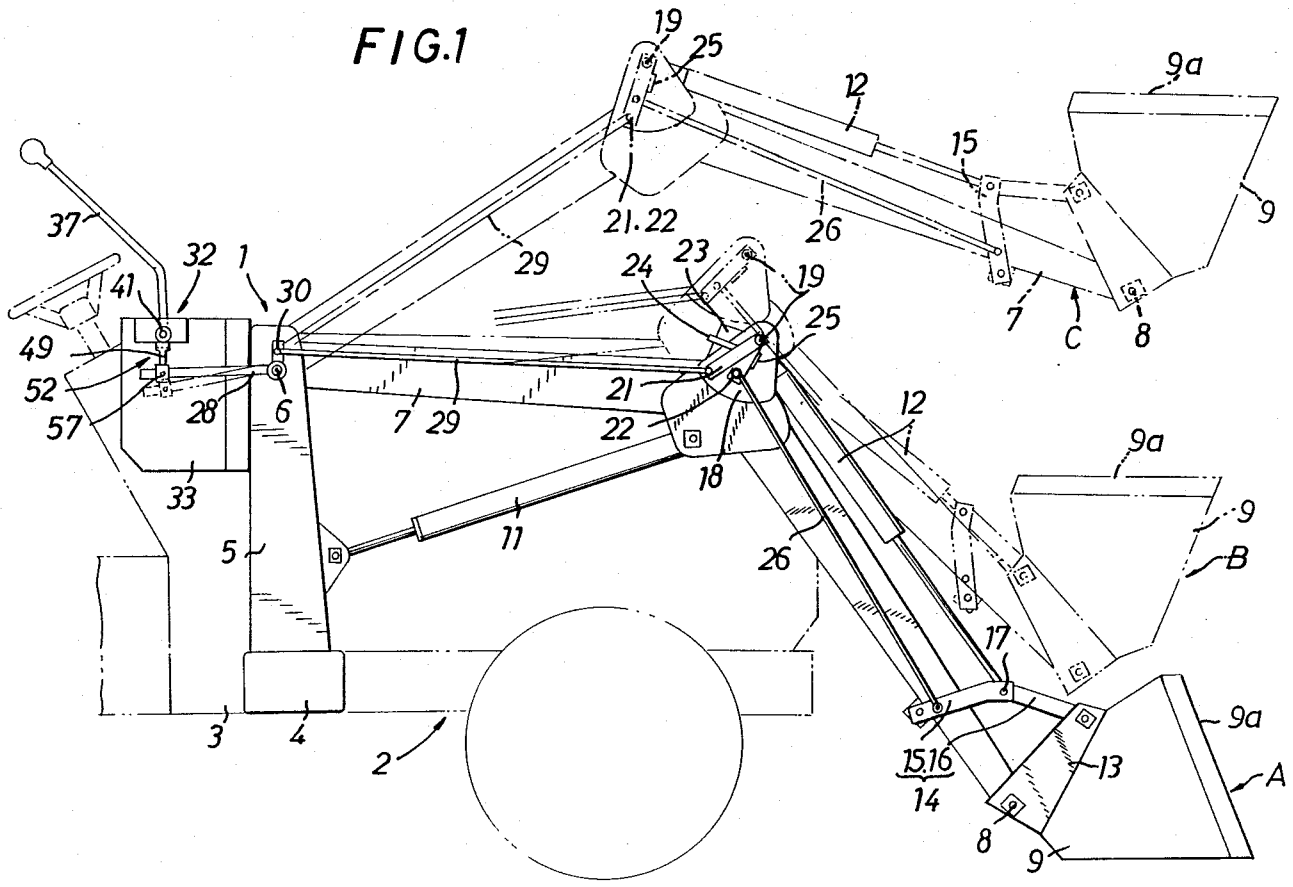
FIGS. 1 to 7 show an embodiment of the present invention.
Figure 3:
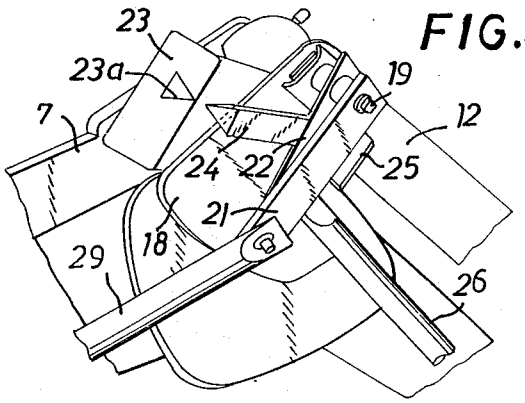

Embodiments of the invention will be described below with reference to the drawings.

Referring to FIGS. 1 to 7, a front loader 1 of the bucket type is attached to the front portion of a tractor 2. The tractor body 3 has a pair of mounts 4 on its opposite sides. A pair of masts 5 are removably fixed to the upper portions of the mounts. A pair of booms 7 are supported by a pivot 6 on the upper portions of the respective masts 5 and are movable upward and downward. A bucket (work implement) 9 is supported by a pivot 8 on the forward ends of the booms 7.

Each of the booms 7 is bent at an intermediate portion thereof, and the rear portion from the bent portion to the mast 5 and the front portion from the bent portion to the bucket 9 are approximately straight.

The bucket 9 has an opening 9*a* at its front as positioned as indicated in solid line in FIG. 1. Besides the bucket, a fork, a grader, a bucket of a backhoe or the like can be used as the work implement.

Provided between the intermediate portion of each boom 7 and a lower portion of the mast 5 is a boom cylinder 11 for raising and lowering the boom. A bucket cylinder 12 is provided between the boom intermediate portion and the bucket 9 for causing the bucket to perform a scooping movement and a dumping movement. The bucket 9 has a pair of brackets 13 secured to its rear side, and the lower portion of each bracket 13 is connected to the boom 7. Two links 15, 16 are connected at their outer ends between the bracket upper portion and the boom 7 for forming a four-point link assembly 14. The other ends of the two links 15, 16 are connected together by a pin 17 having the rod of the bucket cylinder 12 connected thereto. The four-point link assembly 14 is provided to make the bucket 9 movable through an increased angle.

A sectorial support plate 18 is secured to the lengthwise intermediate portion of one of the opposed booms 7. The support plate 18 has a lateral pin 19 for supporting the bucket cylinder 12. The pin 19 is projected laterally from the plate 18 for supporting on its outer end two arms 21 and 22 movably relative to each other. A horizontal indicating panel 23 is secured to the support plate 18, and a pointer 24 opposed to the panel 18 is provided on the second arm 22. Although the lateral pin 19 for the cylinder 12 also serves to support the arms 21, 22, another laterally projecting pin may be provided on the support plate 18 or on the boom intermediate portion.

The second arm 22, which is positioned closer to the support plate 18 than the first arm 21, has fixed to its front side edge a contact plate providing an engaging portion 25 which is adapted to contact the first arm 21. A rod (second connecting member) 26 has one end connected to the free end of the second arm 22 and the other end connected to an intermediate portion of the link 15 pivoted to the boom 7. Through the links 15, 16 and the rod 26, the second arm 22 is pivotally movable with the scooping movement and dumping movement of the bucket 9 to detect the posture of the bucket 9. The rod 26 extends approximately alongside the front portion of the boom 7. A rod 29 extends generally alongside the rear portion of the boom 7. Thus, the two rods 26 and 29 are protected by the boom 7.

The rod 29 (first connecting member) has a front end connected to the free end of the first arm 21 and a rear end screwed on a screw portion 62 of a connector 61. The connector 61 is connected to a pivotal member 28. The distance between the first arm 21 and the pivotal member 28 is therefore adjustable. Such a means for adjusting the length of the rod 29 can also be used for the rod 26.

The horizontal indicating panel 23 bears a mark 23*a* which is positioned opposite the pointer 24 when the opening 9*a* of the bucket 9 is positioned substantially horizontally. The mark is so positioned as to be readily observable by the operator on the tractor 2.

The pivot 6 on the mast 5 has one end projecting laterally therefrom. The pivotal member (bell crank) 28, which is L-shaped when seen from one side, is supported by the projected end. A pin 30 connecting one end of the pivotal member 28 to the rear end of the rod 29, i.e. to the connector 61, is positioned above the pivot 6 away therefrom. With reference to FIG. 1, the upward or downward movement of the boom 7 therefore varies the distance from the lateral pin 19 to the connecting pin 30. Clockwise movement of the first arm 21 moves the pivotal member 28 counterclockwise.

A mount plate 33 for a control unit 32 is attached to the rear side of the mast 5 at its upper portion. With reference to FIGS. 1 and 4 to 7, indicated at 34 is a boom control valve for controlling the boom cylinders 11, and at 35 a bucket control valve for controlling the bucket cylinders 12. These control valves 34, 35, each of which is a three-way valve of the spool type, are fixed to the mount plate 33 with spools 34*a*, 35*a* positioned vertically. The spools 34*a*, 35*a* of the control valves 34, 35 are returned to the neutral position by return springs 34*b*, 35*b*, respectively. The return spring may be provided on a control lever 37.

A control box 36 above the control valves 34, 35 is fixed to the mount plate 33, supports the control lever 37 and has a lever guide portion 38. Fixedly provided inside the box 36 is a bracket 39 which is channel-shaped when seen from above. A lateral first pivot 41 secured to a first pivotal element 40 is rotatably supported by the bracket 39. A second pivotal element 42 is disposed in a U-shaped portion of the first pivotal element 40 and supported by a second pivot 43 extending in the front-to-rear direction. The axes of the first pivot 41 and the second pivot 43 intersect each other at right angles.

The control lever 37 has its base end secured to the second pivotal element 42, which has two pin portions 44 and 45 projecting therefrom leftward and rightward and having an axis intersecting the axis of the second pivot 43. The pin portions can be coaxial with the first pivot 41. The first pin portion 44 is connected to the spool 35*a* of the bucket control valve 35 by a ball joint 46 and a rod 47. The second pin portion 45 is connected to the rear end of the pivotal member 28 by a ball joint 48, rod 49 and pin 57. The ball joint 48 and the rod 49 provide interlocking means 52 for transmitting the movement of the pivotal member 28 to the second pivotal element 42.

The rods 47, 49 are screwed in the ball joints 46, 48, respectively, and are adjustable in length by varying the amount of screw-thread engagement to adjust the distance from the first pin portion 44 to the spool 35*a* and the distance from the second pin portion 45 to the pivotal member 28, whereby the control operation of the control valve 35 is adjustable.

The first pivotal element 40 has a forwardly projecting arm portion 40*a*, which is connected to the spool 34*a* of the boom control valve 34 by a joint 51 and a rod 50. The rod 50 is screwed in the joint 51 and is adjustable in length.

The control unit 32 operates as follows. The single control lever 37, when shifted upward or downward in FIG. 5, moves the first pivotal element 40 about the first pivot 41, pushing the spool 34*a* of the boom control valve 34 downward or upward and causing the boom cylinders 11 to lower or raise the booms 7. When the control lever 37 is shifted leftward or rightward in FIG. 5, the second pivotal element 42 is moved about the second pivot 43 to push the spool 35*a* of the bucket control valve 35 downward or upward, causing the bucket cylinders 12 to pivotally move the bucket upward or downward. Further when the lever 37 is shifted obliquely, the control valves 34, 35 operate at the same time, whereby the booms 7 and the bucket 9 can be moved at the same time. The control valves 34 and 35 can be moved independently of each other and also at the same time by the control lever 37.

When the control lever 37 is moved laterally, the movement of the second pivotal element 42 moves the pivotal member 28 through the rod 49, causing the rod 29 to pivotally move the first arm 21.

Thus according to the present embodiment, the depression of the spool 35*a* of the bucket control valve 35 pivotally moves the bucket 9 upward for scooping, while the spool 35*a*, when pulled up, causes the bucket 9 to perform a dumping action.

Alternatively, the control unit can be so adapted that the depression of the bucket control valve spool 35*a* effects the dumping movement and that the spool 35*a* is pulled up for the scooping movement. The pivotal member 28 can then be connected directly to the rod 47 or the spool 35*a* for the rod 47 and the like to serve as the interlocking means 52 for transmitting the movement of the pivotal member 28 to the bucket control valve 35.

On flat ground, the bucket 9 can be made to scoop up or dump earth from a scooping posture A, shown in solid line in FIG. 1, wherein the bottom of the bucket is positioned horizontally. After scooping earth up, the bucket cylinders 12 are contracted to continue the scooping movement until the opening 9*a* is brought to a horizontal position to prevent the earth from spilling. When the bucket 9 is on the ground with the booms 7 lowered, the bucket 9 can be moved upward to a position in which the opening 9*a* is tilted slightly rearward, but when raising the earth, the bucket is set in a specified posture B wherein the opening 9*a* is approximately horizontal. This specified posture B can be visually recognized with reference to the pointer 24 which is caused to point to the mark 32*a* by the link 15, rod 26 and second arm 22.

When the bucket 9 is brought approximately to the specified posture B in contact with the ground, the second arm 22 is pivotally moved toward the first arm 21, bringing the engaging portion 25 closer to the first arm 21. When the boom cylinders 11 are extended in this state, raising the booms 7 about the pivot 16 to lift the bucket 9 to the dot-and-dash line position of FIG. 1, the lateral pin 19 is moved upward about the pivot 6, with the rod 29 moved upward about the pin 30, decreasing the distance from the lateral pin 19 to the pin 30 and relatively moving the first arm 21 about the lateral pin 19 counterclockwise in FIG. 1, whereby the first arm 21 is brought into contact with the engaging portion 25 of the second arm 22 in an initial stage of rise of the booms. In this state, the first arm 21 is restrained by the second arm 22 from counterclockwise movement in FIG. 1 and made immovable relative to the arm 22 unless the bucket cylinders 12 are operated, with the result that the link mechanism comprising the first and second arms 21, 22 and rods 26, 29 remains stationary relative to the booms 7.

While the booms 7 further rise to a lifted position C indicated in dotted line in FIG. 1, the distance from the lateral pin 19 to the pin 30 further decreases. However, the first arm 21 is in contact with the engaging portion 25 and therefore remains stationary relative to the second arm 22. Consequently, the pivotal member 28 relatively moves counterclockwise in FIG. 1 to move the second pivotal element 42 through the rod 49 and the ball joint 48, thereby pulling up the spool 35*a* and causing the bucket control valve 35 to effect a dumping movement.

This dumping movement continues during the rise of the booms 7, finely moving the bucket 9 toward the dumping direction, so that the second arm 22 is moved counterclockwise in FIG. 1. When the booms 7 stop rising, the first arm 21 remains in engagement with the engaging portion 25, but the pivotal member 28 is so positioned as to position the bucket control valve 35 in its neutral position. This position is maintained by the return spring 35*b* of the spool 35*a*.

Thus, the bucket 9 moves in the dumping direction as the booms 7 rises to hold the opening 9*a* horizontal, thereby preventing the earth from spilling toward the tractor 2. The posture of the bucket is automatically, mechanically controllable and therefore very reliably without necessitating manipulation therefor.

With the booms 7 in its lifted position C, the bucket 9 is moved for dumping by pulling up the spool 35*a* by the control lever 37. At this time, the first arm 21 moves away from the engaging portion 25.

The adjustment of the length of the rod 26, 29 or 49 results in the adjustment of the time when the engaging portion 25 engages with the first arm 21 to forcibly operate the bucket control valve 35. This adjustment is made to determine the specified posture of the bucket 9 or alter the specified posture and accomplished chiefly by adjusting the length of the rod 49.

The specified posture of the work implement is such that when it is the bucket 9, the opening 9*a* is horizontal. When the implement is a fork, the posture is the position in which grass or the like will not fall off. When the bucket 9 is in the specified posture on flat ground, the opening 9*a* is parallel to the ground and the tractor. On an upward or downward slope, the opening is in an absolutely horizontal position inclined with respect to the ground and the tractor. To assure such absolutely horizontal position, the length of the rod 26, 29 or 49 is adjusted according to the slope of the ground.

The specified posture of the work implement has a small allowance range in the scooping and dumping directions, such that with the booms 7 in the lowermost position, the bucket control valve 35 may start operating when the bucket opening 9*a* is brought to the absolutely horizontal position or to a position slightly tilted forward or rearward from this position.

Figure 9:
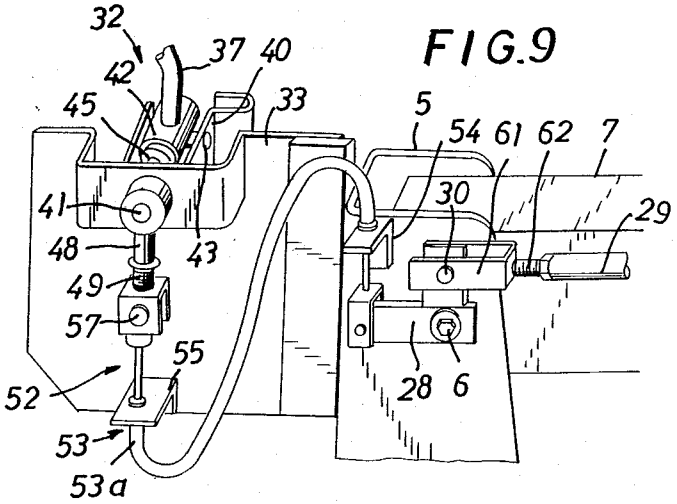
FIGS. 8 and 9 show a modified embodiment of the invention.
Figure 2:
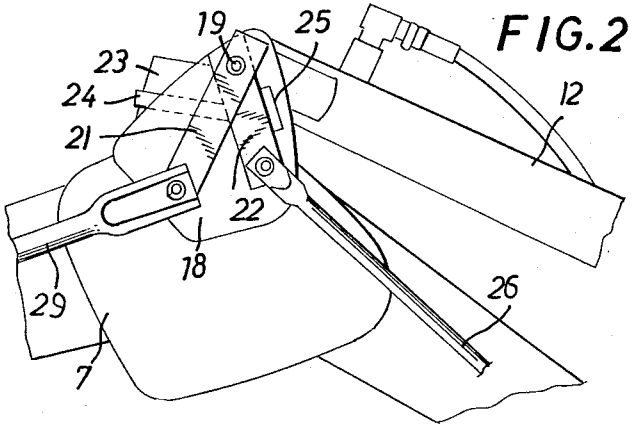
Figure 4:
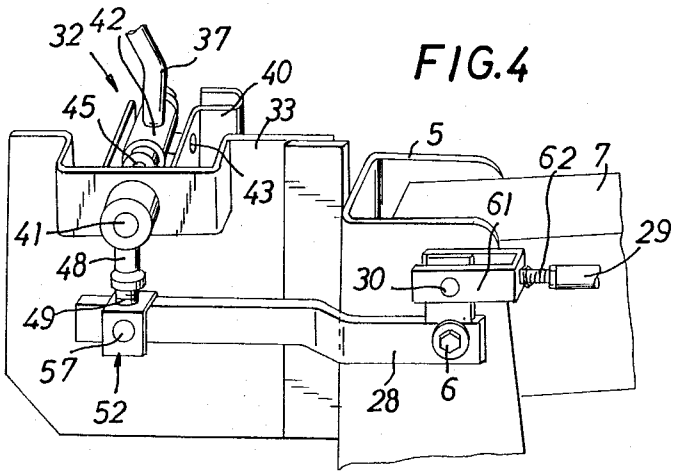
Figure 8:
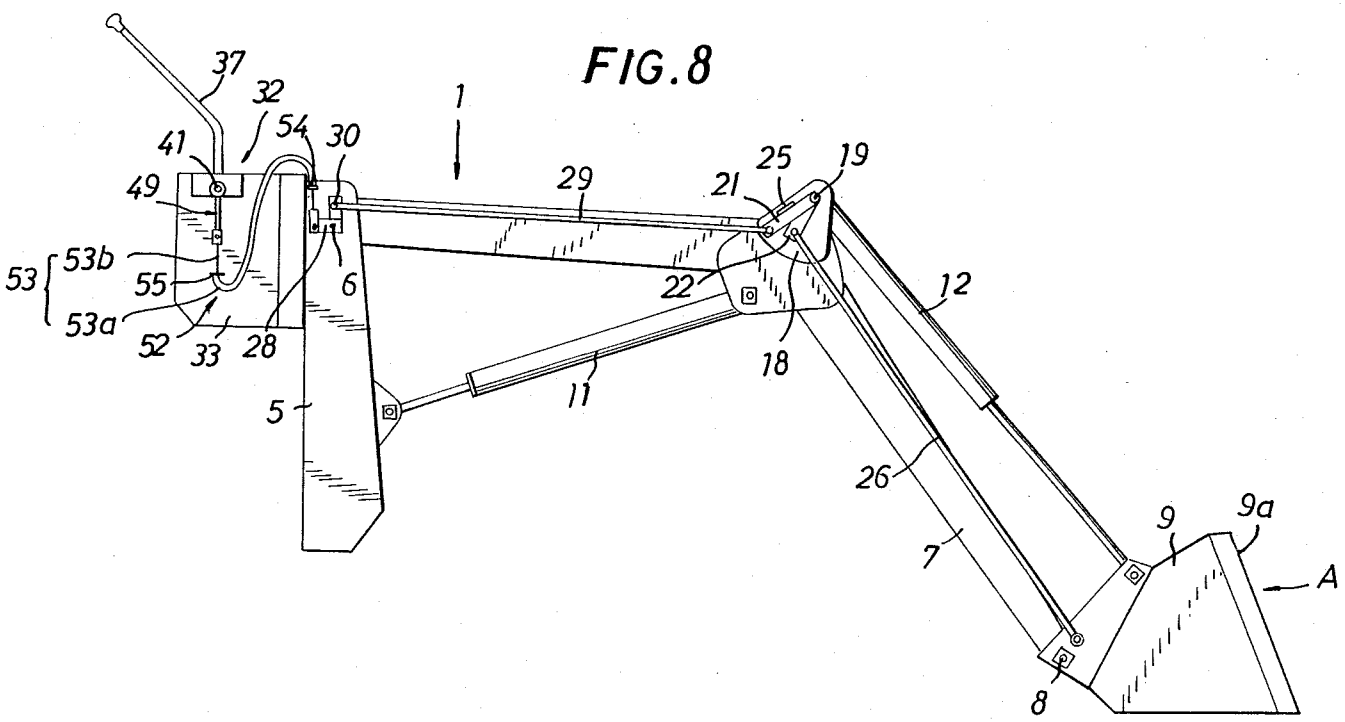

FIGS. 8 and 9 show a modified embodiment. The bracket 13 on the rear side of the bucket 9 is not provided with any flexible link but is directly connected at its upper portion to the bucket cylinder 12 and at an intermediate portion thereof to the rod 26. The engaging portion 25 is provided on the first arm 21 and adapted to contact with the second arm 22.

The pivotal member 28 of the embodiment is in the form of an L-shaped bell crank having two short arms. Interlocking means 52 for operatively connecting one of the arms to the second pivotal element 42 comprises a Bowden cable 53, which comprises an outer wire 53*a* connected at its respective ends to a bracket 54 secured to the mast 5 and to a bracket 55 secured to the mount plate 33, and an inner wire 53*b*. The inner wire 53*b* has one end connected to the above-mentioned arm of the pivotal member 28 by a pin 57 and the other end connected to the second pin portion 45 directly, or through the ball joint 48 or through the ball joint 48 and the rod 49.

With the modified embodiment, the Bowden cable 53 can be of a large length, so that the control unit 32 need not be attached to the mast 5 but can be disposed, for example, in the vicinity of the seat of the tractor 2. This makes it possible to position the control unit 32 as desired relative to the pivotal member 28.

However, since the Bowden cable 53 has some elongation and attachment errors, the control unit is operable with higher accuracy when an interlocking means 52' comprising the ball joint 48 and rod 49 is used in combination with a pivotal member 28 having an elongated arm and connected directly to the rod 49 as in the foregoing embodiment.

Figures 5, 6, 7, 10:
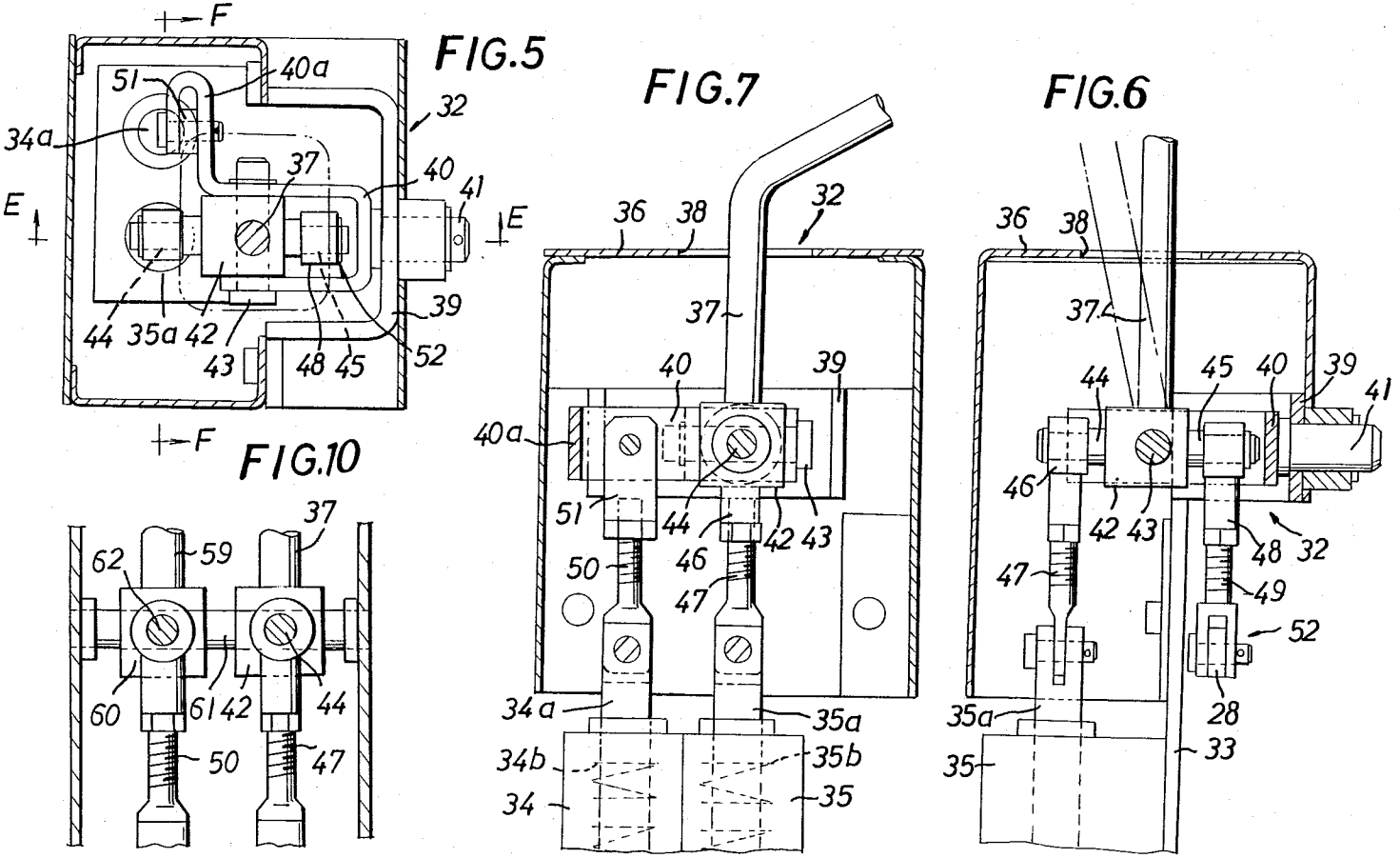
FIG. 10 is a sectional view showing modified control lever means.

FIG. 10 shows modified control lever means. The boom control valve 34 and the bucket control valve 35 have their own control levers 59, 37. Pivotal elements 60, 42 for the control levers 59, 37 are rotatably supported on a single pivot 61 supported by the control box 36. A rod 50 is connected to a pin portion 62 projecting from the pivotal element 60, and a rod 47 to a pin portion 44 projecting from the pivotal element 42. The pivotal element 42 or the control lever 37 has a pin portion for connection to the interlocking means.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An apparatus for controlling the posture of the work implement of a loader having a pair of masts secured to a vehicle body, a boom supported by a boom pivot on each of the masts and movable upward and downward by a boom cylinder, the work implement being pivotally movably supported by the forward end of the boom and movable by an implement cylinder for scooping and dumping, and a control unit for controlling the boom cylinder and the implement cylinder, the control unit having a boom control valve for operating the boom cylinder, an implement control valve for operating the implement cylinder, and control lever means for operating the two control valves, the apparatus being characterized in that the apparatus comprises first and second two arms supported by an intermediate portion of the boom and pivotally movable relative to each other, a pivotal member pivoted to the boom coaxially with the boom pivot, a first connecting member operatively connecting a point on the pivotal member away from the pivoted point thereof to the first arm, a second connecting member connecting the second arm to the work implement, engaging means for engaging the second arm with the first arm when the work implement is pivotally moved toward the scooping direction approximately into a specified posture, and interlocking means operatively connecting the pivotal member to the implement control valve so that the implement control valve is operated for dumping by the movement of the pivotal member with the rise of the boom after the second arm is engaged with the first arm by the engaging means.

2. The apparatus as defined in claim 1 wherein the boom is bent at the intermediate portion, and the rear portion of the boom from the bent portion to the mast and the front portion thereof from the bent portion to the work implement are substantially straight, the bent portion being provided with a lateral pin for supporting the boom cylinder and a lateral pin for supporting the two arms, the first connecting member extending substantially alongside the boom rear portion, the second connecting member extending substantially alongside the boom front portion.

3. The apparatus as defined in claim 2 wherein the lateral pin for supporting the boom cylinder and the arm supporting lateral pin are combined together in the form of a single pin, and the arm supporting lateral pin extends laterally from the bent portion.

4. The apparatus as defined in claim 2 wherein the bent portion has a support plate secured to the boom, and the support plate carries the boom cylinder supporting lateral pin and the arm supporting lateral pin and is provided with a horizontal indicating panel, the second arm having a pointer opposed to the indicating panel.

5. The apparatus as defined in claim 2 wherein the first connecting member and the second connecting member are each in the form of a rod, and at least one of the connecting members is adjustable in length.

6. The apparatus as defined in claim 1 wherein the work implement is connected at its rear lower portion to the forward end of the boom and has first and second two links flexibly connected together end-to-end by a connecting pin, the first link being connected at the other end thereof to the boom in the vicinity of its forward end, the second link being connected at the other end thereof to the rear upper portion of the work implement, the implement cylinder being connected to the connecting pin, the second connecting member being connected to an intermediate portion of the first link.

7. The apparatus as defined in claim 1 wherein the work implement is connected at its rear lower portion to the forward end of the boom, at its rear upper portion to the implement cylinder and at a rear intermediate portion to the second connecting member.

8. The apparatus as defined in claim 1 wherein the work implement is a bucket having at its front an opening holdable approximately in an absolutely horizontal specified position.

9. The apparatus as defined in claim 1 wherein the engaging means is an engaging portion projecting from one of the first and second arms toward the other arm and adapted to contact the other arm when the work implement is pivotally moved for scooping into the specified posture with the boom in its lowered position, permitting the second arm to pivotally move toward the first arm substantially into a lapping relation therewith.

10. The apparatus as defined in claim 9 wherein the engaging portion comes into contact with the other arm when the work implement is moved toward the scooping direction slightly beyond the specified posture.

11. The apparatus as defined in claim 9 wherein the engaging portion comes into contact with the other arm when the working implement is brought into the specified posture.

12. The apparatus as defined in claim 1 wherein the pivotal member comprises a bell crank, and the boom pivot is projected laterally from the mast, the bell crank being supported by the projected pivot portion and having one end connected to the first connecting member and the other end connected to the interlocking means.

13. The apparatus as defined in claim 1 wherein the control lever means is in the form of a single control lever, and a control box having a lever guide portion for guiding the control lever is disposed above the boom control valve and the implement control valve, the control box being provided with a first pivotal element movable about a first pivot for operating the boom control valve, and a second pivotal element movable about a second pivot for operating the implement control valve, the second pivot having an axis intersecting the axis of the first pivot at right angles therewith, the control lever being attached to the second pivotal element, the interlocking means being provided between the second pivotal element and the pivotal member.

14. The apparatus as defined in claim 13 wherein the interlocking means comprises a ball joint fitted to a pin portion projecting from the second pivotal element and a rod having one end screwed in the ball joint adjustably in its length and the other end connected to the pivotal member.

15. The apparatus as defined in claim 13 wherein the interlocking means comprises a Bowden cable having one end connected to the second pivotal element and the other end connected to the pivotal member.

16. The apparatus as defined in claim 1 wherein the control lever means comprises a control lever for operating the boom control valve and a control lever for operating the implement control valve, and the interlocking means is provided between the control lever for the implement control valve and the pivotal member.

17. An apparatus for controlling the posture of the work implement of a loader comprising a pair of mounts provided at the lower portion of a vehicle body on the respective opposite sides thereof, an upright mast removably attached to each of the masts, a boom bent at an intermediate portion thereof and supported at its base end by a boom pivot on the upper portion of the mast, a boom cylinder connected between the lower portion of the mast and the intermediate portion of the boom for moving the boom upward and downward, a bucket having an opening at its front and pivoted at its rear lower portion to the forward end of the boom, a first link connected at its one end to the boom in the vicinity of the forward end thereof, a second link connected at its one end to the rear upper portion of the bucket, the two links being flexibly connected together at the other ends thereof by a connecting pin, a support plate attached to the intermediate portion of the boom and having a lateral pin, a bucket cylinder connected between the lateral pin and the connecting pin for causing the bucket to perform a scooping movement and a dumping movement, a first arm and a second arm both supported by the outer end of the lateral pin projecting laterally from the support plate, the first and second arms being pivotally movable relative to each other, the second arm being connected to an intermediate portion of the first link by a second rod, one of the two arms being provided with an engaging portion adapted to contact the other arm when the bucket is brought into a specified posture with its opening approximately in an absolutely horizontal position while the boom is in its lowered position, a bell crank supported by the outer end of the boom pivot projected laterally from the mast, the bell crank having one end connected to the first arm by a first rod, a boom control valve having a spool and connected to the boom cylinder, a bucket control valve having a spool and connected to the bucket cylinder, a control box disposed above the two control valves, the two control valves and the control box being mounted on the rear upper portion of the mast, a first pivotal element movably supported by a first pivot on the control box and connected to the spool of the boom control valve, a second pivotal element movably supported by a second pivot on the first pivotal element, the second pivot having an axis intersecting the axis of the first pivot at right angles therewith, the second pivotal element being connected to the spool of the bucket cylinder and being connected to the other end of the bell crank by interlocking means, and a single control lever attached to the second pivotal element, the control box having a lever guide portion for the control lever, the control valves being each provided with spring means for returning the spool to its neutral position, whereby as the boom is raised by the boom cylinder after the engaging portion has come into contact with the other arm with the bucket opening brought to the absolutely horizontal position by the scooping movement of the bucket, the bell crank is pivotally moved to cause the second pivotal element to operate the bucket control valve for. dumping through the interlocking means and thereby hold the bucket opening in the absolutely horizontal position.

18. The apparatus as defined in claim 17 wherein the second pivotal element is provided with first and second two pin portions coaxial with each other and having an axis intersecting the axis of the second pivot at right angles therewith, a ball joint being connected to each of the pin portions, a rod being screwed in the ball joint of the first pin portion adjustably in its length and connected to the spool of the bucket control valve, another rod being screwed to the ball joint of the second pin portion adjustably in its length and connected to the pivotal member.

* * * * *